US008980023B2

(12) United States Patent
Lund

(10) Patent No.: US 8,980,023 B2
(45) Date of Patent: Mar. 17, 2015

(54) GAS GENERATION VIA ELEMENTAL CARBON-BASED COMPOSITIONS

(75) Inventor: Gary K. Lund, Malad City, ID (US)

(73) Assignee: Autoliv ASP, Inc., Ogden, UT (US)

( * ) Notice: Subject to any disclaimer, the term of this patent is extended or adjusted under 35 U.S.C. 154(b) by 0 days.

(21) Appl. No.: 13/191,760

(22) Filed: Jul. 27, 2011

(65) Prior Publication Data

US 2013/0025749 A1 Jan. 31, 2013

(51) Int. Cl.

| | |
|---|---|
| ***C06B 31/10*** | (2006.01) |
| ***C06B 29/02*** | (2006.01) |
| ***D03D 23/00*** | (2006.01) |
| ***D03D 43/00*** | (2006.01) |
| ***C06D 5/06*** | (2006.01) |
| ***C06B 23/00*** | (2006.01) |

(52) U.S. Cl.

CPC ..... *C06D 5/06* (2013.01); *C06B 23/007* (2013.01)

USPC ..... 149/71; 149/77; 149/109.4; 149/109.6

(58) Field of Classification Search

USPC ..... 149/71, 77, 109.4, 109.6

See application file for complete search history.

(56) References Cited

U.S. PATENT DOCUMENTS

| | | | | |
|---|---|---|---|---|
| 6,605,233 | B2 | 8/2003 | Knowlton et al. | |
| 6,645,326 | B2 | 11/2003 | Canterberry et al. | |
| 6,893,517 | B2 * | 5/2005 | Zeuner et al. | 149/77 |
| 7,147,733 | B2 | 12/2006 | Barnes et al. | |
| 2003/0145926 | A1 * | 8/2003 | Zeuner et al. | 149/77 |
| 2006/0289096 | A1 | 12/2006 | Mendenhall et al. | |
| 2008/0272204 | A1 | 11/2008 | McNichols et al. | |
| 2009/0008001 | A1 | 1/2009 | Mendenhall et al. | |
| 2009/0020197 | A1 * | 1/2009 | Hosey | 149/22 |
| 2013/0026742 | A1 | 1/2013 | Young et al. | |
| 2013/0199399 | A1 | 8/2013 | Young et al. | |

FOREIGN PATENT DOCUMENTS

| | | |
|---|---|---|
| GB | 638893 | 6/1950 |
| WO | WO 2008/145935 A2 | 12/2008 |

* cited by examiner

*Primary Examiner* — James McDonough

(74) *Attorney, Agent, or Firm* — Pauley Petersen & Erickson

(57) ABSTRACT

A gas generating pyrotechnic composition that in addition to a primary fuel component and a primary oxidizer component includes critical relative amounts of elemental carbon and cupric oxide. Also provided are associated methods for producing an inflation gas for an occupant restraint system of a motor vehicle.

20 Claims, 1 Drawing Sheet

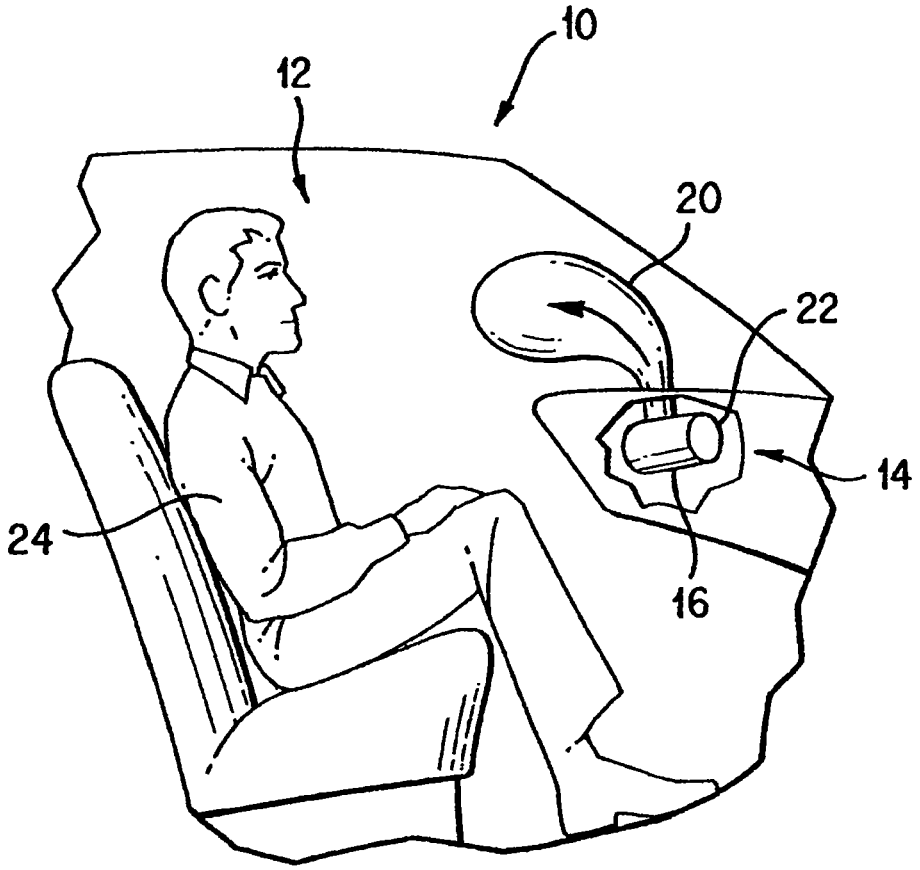
10
12
20
22
14
24
16

GAS GENERATION VIA ELEMENTAL CARBON-BASED COMPOSITIONS

BACKGROUND OF THE INVENTION

This invention relates generally to gas generation and, more particularly, to devices and methods for inflating inflatable devices such as inflatable vehicle occupant restraints of respective inflatable restraint systems.

It is well known to protect a vehicle occupant using a cushion or bag, e.g., an "airbag cushion," that is inflated or expanded with gas such as when the vehicle encounters sudden deceleration, such as in the event of a collision. In such systems, the airbag cushion is normally housed in an uninflated and folded condition to minimize space requirements. Upon actuation of the system, the cushion begins to be inflated, in a matter of no more than a few milliseconds, with gas produced or supplied by a device commonly referred to as a "gas generator" or an "inflator."

Many types of inflator devices have been disclosed in the art for the inflating of one or more inflatable restraint system airbag cushions. Prior art inflator devices include compressed stored gas inflators, pyrotechnic inflators and hybrid inflators. Unfortunately, each of these types of inflator devices has been subject to certain disadvantages such as one or more of having a greater than desired weight, requiring more than desired space or volume, and producing undesired or nonpreferred combustion products in greater than desired amounts, for example.

Vehicular inflatable restraint systems and their manufacturers typically face the objectives of increased airbag performance and safety while also seeking to reduce or minimize costs. To this end, significant research efforts and expenditures have gone into increasing the functionality of the propellant or gas generant material for use in airbag inflators and reducing the cost with an end goal of simultaneously improving performance and reducing the cost for the entire inflatable restraint system.

Improved performance for pyrotechnic-containing gas generators or inflators may be achieved in a variety of ways, many of which ultimately depend on the gas generant formulation or composition to provide desired properties. Ideally, a gas generant provides or results in sufficient mass flow of gas in a desired time interval to achieve the required work impulse for the associated inflating device. The temperature of the produced gas influences the amount of work the generant gases can do. Traditionally, the production of high temperature gases can be troublesome such as to typically require that managing of the thermal energy during the inflation event.

In general, the burn rate for a gas generant composition can be represented by the equation (1), below:

$$Rb=k(P)^n \quad (1)$$

where,

Rb=burn rate (linear)

k=constant

P=pressure n=pressure exponent, where the pressure exponent is the slope of a linear regression line drawn through a log-log plot of burn rate versus pressure.

In such a burn rate equation, the pressure exponent, "n" is an indication of the pressure sensitivity of the burning rate. That is, a composition that exhibits a larger pressure exponent indicates that the burn rate of the composition is more highly sensitive to the surrounding pressure.

Gas generant materials or compositions that produce high temperature gases, such as evidenced by compositions having a high flame temperature, with high gas yields can find advantageous application in inflators that employ another working fluid such as a stored gas or liquid, such as in various hybrid inflators, for example. More particularly, in such inflator applications only a relatively small amount of a high temperature, high gas yield gas generant material or composition is required to heat the working fluid to a desired and useful temperature resulting in overall cost and weight savings for the inflator and the inflatable restraint system as a whole as compared to inflators and systems employing conventional cooler burning gas generant compositions.

Thus, there is a need and a demand for gas generant compositions, particularly, gas generating pyrotechnic compositions that produce high yields of gas at high temperatures with rapid burning rates to maximize the volumetric performance of the composition.

SUMMARY OF THE INVENTION

The present invention provides improved gas generating pyrotechnic compositions and associated or corresponding methods for producing gas such as for use in an occupant restraint system of a motor vehicle.

In accordance with one aspect, there is provided a gas generating pyrotechnic composition that includes primary fuel component, a primary oxidizer component, elemental carbon present in a relative amount of 1 to 10 composition weight percent; and cupric oxide present in a relative amount of greater than 2 composition weight percent up to 15 composition weight percent.

In one embodiment, such a gas generating composition includes a primary fuel component including guanidine nitrate in a relative amount of 10 to 40 composition weight percent, a primary oxidizer component including ammonium perchlorate in a relative amount of 25 to 75 composition weight percent, elemental carbon present in a relative amount of 3 to 10 composition weight percent; and cupric oxide present in a relative amount of 3 to 15 composition weight percent.

Another aspect involves a method for producing an inflation gas for an occupant restraint system of a motor vehicle. In accordance with one such embodiment, such a method includes igniting a supply of a gas generating pyrotechnic composition that includes:

10 to 40 composition weight percent guanidine nitrate;

25 to 75 composition weight percent ammonium perchlorate;

3 to 10 composition weight percent elemental carbon; and 3 to 15 composition weight percent cupric oxide, to produce a generated gas in high yield and a flame temperature in excess of 2400 K.

As used herein, references to elemental carbon are to be understood to generally refer to carbon in an uncombined form. It will be appreciated that elemental carbon in accordance with the invention may contain or include small or minor amounts of impurities, such as are known or commonly associated with carbon.

Also, references herein to gas generant and/or pyrotechnic compositions that produce "high gas yields" generally refer to such compositions as yield or produce greater than 6 moles of gas per 100 cc of the composition.

References herein to gas generant and/or pyrotechnic compositions that produce gas at "high temperatures" generally refer to such compositions as yield or produce gas at a flame temperature in excess of 2400 K.

References herein to a specific composition, component or material as a "fuel" are to be understood to refer to a chemical which generally lacks sufficient oxygen to burn completely to $CO_2$, $H_2O$ and $N_2$.

Correspondingly, references herein to a specific composition, component or material as an "oxidizer" are to be understood to refer to a chemical generally having more than sufficient oxygen to burn completely to $CO_2$, $H_2O$ and $N_2$.

References herein to fuel or oxidizer as a "primary" fuel or oxidizer, respectively, are to be understood to refer to such fuel or oxidizer that is respectively present in a specific composition, component or material in greatest relative amount. Correspondingly, references to a fuel or oxidizer as a "secondary" fuel or oxidizer, respectively, are to be understood to refer to such fuel or oxidizer that is respectively present in a specific composition, component or material in a lesser relative amount as compared to a primary fuel or oxidizer.

References herein to a gas generating pyrotechnic composition having a "high" burning rate are to be understood to refer to such a composition that exhibits a burning rate calculated using the gas generant composition burn rate equation (1), identified above, of greater than 1 inch per second (ips) at 3000 psi (25.4 mm/s at 20.8 MPa).

References herein to a gas generating pyrotechnic composition having a "low" burning rate pressure exponent are to be understood to refer to such a composition that exhibits a burning rate pressure exponent as represented by the pressure exponent (n) in the gas generant composition burn rate equation (1), identified above. of less than 0.5.

Other objects and advantages will be apparent to those skilled in the art from the following detailed description taken in conjunction with the appended claims and drawing.

BRIEF DESCRIPTION OF THE DRAWING

The FIGURE is a simplified schematic, partially broken away, view illustrating the deployment of an airbag cushion from an airbag module assembly within a vehicle interior, in accordance with one embodiment of the invention.

DETAILED DESCRIPTION OF THE INVENTION

There is provided an improved gas generant or gas generating pyrotechnic composition such as for use in the inflation of inflatable elements such as an airbag cushion of a vehicular inflatable restraint system. In accordance with a preferred embodiment, such a gas generating pyrotechnic composition, in addition to a primary fuel component and a primary oxidizer component, also particularly includes elemental carbon and cupric oxide. More particularly, such compositions preferably include or contain such elemental carbon in a relative amount of 1 to 10 composition weight percent and such cupric oxide in a relative amount of greater than 2 composition weight percent up to 15 composition weight percent, preferably in a range of 3 to 15 composition weight percent.

In such compositions, elemental carbon serves as a high temperature fuel which, during the combustion process, produces only gas. Various forms of elemental carbon, including graphite, amorphous carbon and carbon black, can be used. Graphite is a currently preferred form of elemental carbon for use in the practice of the invention. Advantageously, graphite has a considerably higher density than amorphous carbon and can additionally serve as a process aid (e.g., as a lubricant).

If desired, compositions can also include one or more additional high temperature fuels such as elemental silicon, boron, aluminum, titanium, etc. such as to further increase the flame temperature of the composition, however, the composition must have elemental carbon present regardless.

The presence of cupric oxide together with elemental carbon has now been found important in achieving rapid gas production at a wide range of operating pressures with minimal performance variability. In particular, the presence of cupric oxide together with elemental carbon is believed necessary in order to achieve a desired high burning rate (i.e., a burning rate of greater than 1 inch per second (ips) at 3000 psi (25.4 mm/s at 20.8 MPa)) together with a low burning rate pressure exponent (i.e., a burning rate pressure exponent of less than 0.5).

In addition to serving as a ballistic modifier in the presence of the elemental carbon, cupric oxide can also serve as a co-oxidizer.

The gas generating pyrotechnic composition includes ammonium perchlorate as a primary oxidizer material. In particular, the inclusion of ammonium perchlorate desirably facilitates achieving a desired high gas output and high flame temperature while simultaneously providing sufficient combustion efficiency to ensure that the elemental carbon (especially graphite) fully reacts during the combustion process. Preferred relative amounts of primary oxidizer, particularly, where the primary oxidizer is ammonium perchlorate, are in a range of from about 25 to about 75 composition weight percent.

The composition may also include or contain one or more co-oxidizers such as ammonium nitrate, potassium perchlorate, alkali metal nitrates and peroxides, for example.

While as identified above, elemental carbon can and preferably does serve as a high temperature fuel within the gas generating pyrotechnic composition, guanidine nitrate is a preferred primary fuel component for inclusion in the gas generating pyrotechnic composition. In particular, the presence of oxygen in guanidine nitrate advantageously reduces or minimizes the amount of oxidizer component needed or required for complete combustion of the composition. Examples of other possible and suitable primary fuel materials include guanylurea nitrate, biguanide nitrate and dinitrate, 5-aminotetrazole and related salts, diammonium bitetrazole, copper diamminedinitrate, diaminodinitroethane and dicyandiamide which can be included in similar amounts to that used for guanidine nitrate.

As will be appreciated by those skilled in the art and guided by the teachings herein provided, the inclusion of ammonium perchlorate in a gas generant composition commonly results in the composition also producing or forming hydrogen chloride as a gaseous byproduct of combustion. The presence of hydrogen chloride in too large of a concentration in a product gas can be either or both toxic and corrosive. While hydrogen chloride gas can be "scavenged" or removed from a combustion gas stream by including a scavenger compound such as an alkali or alkaline earth metal nitrate such as sodium or potassium nitrate in the pyrotechnic gas generant composition, the inclusion of such scavenger decreases the combustion efficiency of the composition and increases the cost of the composition and its use. Thus, those skilled in the art and guided by the teachings herein provided will appreciate that minimization of the amount of an oxidizer such as ammonium perchlorate can be desirable from an effluent point-of-view as hydrogen chloride (HCl) is an undesirable combustion by-product commonly produced or formed upon the combustion of ammonium perchlorate. Moreover, through the minimization of the required amount of oxidizer, the carbon content and hence the relative amount of product gas can desirably be increased or maximized.

The composition may also include or contain one or more co-fuel or secondary fuel materials such as RDX, nitroguanidine, polystyrene, polyacrylates, polyethylene, pentaerythritol and carbohydrates, for example.

In accordance with certain embodiments, relative amounts of primary fuel component, particularly, where the primary fuel component is guanidine nitrate, are in a range of from about 10 to about 70 composition weight percent, with certain embodiments preferably containing guanidine nitrate in a range of from about 10 to about 40 composition weight percent. In accordance with certain preferred embodiments, in those gas generating pyrotechnic compositions that do not include a secondary fuel, a preferred relative amount of the primary fuel component, particularly, where the primary fuel component is guanidine nitrate, is in a range of from about 15 to about 40 composition weight percent and a preferred relative amount of ammonium perchlorate primary oxidizer is 25 to 70 composition weight percent.

A gas generating pyrotechnic composition as herein described may, if desired, additionally include one or more gas generating pyrotechnic composition additives, such as known in the art. For example, such a gas generating pyrotechnic composition may contain or include one or more metal oxide burn rate enhancing and/or slag formation additive or the like. Suitable metal oxide additives include, but are not limited to, ferric oxide, bismuth oxide, silicon dioxide, aluminum oxide, zinc oxide, zirconium oxide, titanium dioxide, lanthanum oxide, any of the various aluminosilicates including clays, talcs and mica, and combinations thereof. In practice, a gas generating pyrotechnic composition as herein described may in some embodiments include up to about 10 composition weight percent of at least one such metal oxide additive. In accordance with certain preferred embodiments, a gas generating pyrotechnic composition as herein described may desirably contain or include about 0.5 to about 3 composition weight percent of at least one such metal oxide additive.

In view of the above, a particular preferred gas generating pyrotechnic composition alternatively, comprises, consists and consists essentially of:

a primary fuel component including guanidine nitrate in a relative amount of 10 to 40 composition weight percent;

a primary oxidizer component including ammonium perchlorate in a relative amount of 25 to 75 composition weight percent;

elemental carbon present in a relative amount of 3 to 10 composition weight percent; and cupric oxide present in a relative amount of 3 to 15 composition weight percent.

A supply of such a gas generating pyrotechnic composition upon being ignited desirably produces a generated gas in high yield and a flame temperature in excess of 2400 K. As will be appreciated by those skilled in the art and guided by the teaching herein provided, such a generated gas can be employed to contact a working fluid to form an inflation gas such as for the inflation of an occupant restraint disposed within a motor vehicle In a preferred embodiment, such an gas generating pyrotechnic composition burns at a rate in excess of 30 mm/sec at 20 MPa and with a burning rate pressure exponent of less than 0.5. In particular embodiments, the gas generating pyrotechnic composition advantageously exhibits a burning rate pressure exponent of no more than about 0.4. In general, a burning rate pressure exponent value of less than 0.5 is desirable or, alternatively, deemed necessary for proper operation of associated inflation devices with burning rate pressure exponent values of less than 0.4 being desired to either or both minimize performance variability and reduce weight requirements for an associated inflator device to as great an extent as may be desired.

As will be appreciated, gas generating compositions in accordance with the invention can be incorporated, utilized or practiced in conjunction with a variety of different structures, assemblies and systems. As representative, the FIGURE illustrates a vehicle 10 having an interior 12 wherein an inflatable vehicle occupant safety restraint system, generally designated by the reference numeral 14, is positioned. As will be appreciated, certain standard elements not necessary for an understanding of the invention may have been omitted or removed from the FIGURE for purposes of facilitating illustration and comprehension.

The vehicle occupant safety restraint system 14 includes an open-mouthed reaction canister 16 which forms a housing for an inflatable vehicle occupant restraint 20, e.g., an inflatable airbag cushion, and an apparatus, generally designated by the reference numeral 22, for generating or supplying inflation gas for the inflation of an associated occupant restraint. As identified above, such a gas generating device is commonly referred to as an "inflator."

The inflator 22 contains a quantity of a gas generant composition in accordance with the invention and such as described above. The inflator 22 may also include or contain a working fluid such as in a form of a stored gas or liquid, for example, and such as is known in the art and such as may contact with the generated gas to form an inflation gas such as for inflating the inflatable vehicle occupant restraint 20.

The inflator 22 also includes an igniter, such as known in the art, for initiating combustion of the gas generating composition in ignition communication with the gas generant composition. As will be appreciated, the specific construction of the inflator device does not form a limitation on the broader practice of the invention and such inflator devices can be variously constructed such as is also known in the art.

In practice, the airbag cushion 20 upon deployment desirably provides for the protection of a vehicle occupant 24 by restraining movement of the occupant in a direction toward the front of the vehicle, i.e., in the direction toward the right as viewed in the FIGURE.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Examples 1-5

Gas generating pyrotechnic compositions in accordance with the invention and as shown in TABLE 1, below, where values are in terms of composition weight percent, were prepared in laboratory mixtures.

TABLE 1

| INGREDIENT | EX 1 | EX 2 | EX 3 | EX 4 | EX 5 |
|---|---|---|---|---|---|
| AP | 69.99 | 58.07 | 69.67 | 72.77 | 64.01 |
| GN | 16.01 | 30.93 | 16.33 | 10.00 | 25.46 |
| C | 8.00 | 5.00 | 8.00 | 4.00 | 6.42 |

TABLE 1-continued

| INGREDIENT | EX 1 | EX 2 | EX 3 | EX 4 | EX 5 |
|---|---|---|---|---|---|
| CuO | 5.00 | 5.00 | 6.00 | 4.00 | 4.11 |
| $Fe_2O_3$ | 1.00 | 1.00 | — | — | — |
| Pentaerythritol | — | — | — | 9.23 | — |

where,
AP = ammonium perchlorate;
GN = guanidine nitrate; and
C = elemental carbon.

For each of these gas generating pyrotechnic compositions, the theoretical flame temperature ($T_f$), mole gas/kg, mole gas/100 cc, HCl mass %, Mass SIFx (mol-K/g), Vol SIFx (mol-K/cc), density (g/cc), Rb @ 20 MPa (mm/s) and n (pressure exponent in the burn rate equation (1) identified above, where the pressure exponent is the slope of the plot of the log of pressure along the x-axis versus the log of the burn rate along the y-axis) were determined/analyzed and are shown in the TABLE 2, below.

TABLE 2

| | EX 1 | EX 2 | EX 3 | EX 4 | EX 5 |
|---|---|---|---|---|---|
| Tf (K) | 2920 | 2776 | 2920 | 2880 | 2860 |
| Mole gas/kg | 33.6 | 34.9 | 33.7 | 35.3 | 34.95 |
| Mole gas/ 100 cc | 6.52 | 6.40 | 6.53 | 6.62 | 6.47 |
| HCl mass % | 17.6 | 14.4 | 17.9 | 19.79 | 17.23 |
| Mass SIFx (mol-K/g) | 98.11 | 96.88 | 98.40 | 101.66 | 99.96 |
| Vol SIFx (mol-K/cc) | 190.24 | 177.68 | 190.71 | 190.62 | 184.92 |
| Density (g/cc) | 1.939 | 1.834 | 1.938 | 1.875 | 1.85 |
| Rb @ 20 MPA (mm/s) | 37.6 | 36.7 | 38.4 | 37.1 | 35.5 |
| N | 0.39 | 0.40 | 0.37 | 0.36 | 0.38 |

Discussion of Results

Mass SIFx and Vol SIFx are performance parameters useful for comparing the inflation potential of compositions. Mass SIFx is the product of flame temperature and moles of gas produced per unit weight Vol SIFx is the product of flame temperature and moles of gas produced per unit volume.

For purposes of high performance inflation potential for a composition, a value of Mass SIFx of greater than 85 mol-K/g is generally desired and a value of Vol SIFx of greater than 180 mol-K/cc is generally desired. By way of comparison, Mass SIFx values of less than 60 mol-K/g and Vol SIFx values of less than 120 mol-K/cc are typical of conventional gas generant materials utilized in automotive restraint system inflators.

As shown in Table 2 above, burning rates of the compositions are all high being well in excess of 30 mm/sec at 20 MPa and perhaps more importantly, pressure exponents as defined by the value 'n' are low being typically less than 0.4. In general, pressure exponent values of less than 0.5 are necessary for proper operation of inflation devices with values less than 0.4 being desired to minimize performance variability and reduce weight requirements of the inflator.

Examples 6-9 and Comparative Examples 1-3

Gas generating pyrotechnic compositions in accordance with the invention (EX 6-0) and comparative examples (CE 1-3) as shown in TABLE 3, below, where values are in terms of composition weight percent, were prepared in laboratory mixtures.

TABLE 3

| INGREDIENT | EX 6 | CE 1 | EX 7 | CE 2 | CE 3 | EX 8 | EX 9 |
|---|---|---|---|---|---|---|---|
| AP | 64.01 | 67.18 | 62.86 | 63.16 | 64.22 | 53.75 | 45.8 |
| GN | 25.46 | 25.40 | 25.49 | 25.86 | 24.78 | 36.25 | 46.2 |
| C | 6.42 | 6.42 | 5.93 | 5.85 | 6.00 | 4.0 | 2.0 |
| CuO | 4.11 | 1.00 | 2.09 | 1.00 | 0.00 | 6.0 | 6.0 |
| $Fe_2O_3$ | — | — | 3.63 | 4.13 | 5.00 | 0.0 | 0.0 |

where,
AP = ammonium perchlorate;
GN = guanidine nitrate; and
C = elemental carbon.

For each of these gas generating pyrotechnic compositions, the theoretical flame temperature ($T_f$), mole gas/kg, mole gas/100 cc, HCl mass %, Mass SIFx (mol-K/g), Vol SIFx (mol-K/cc), density (g/cc), Rb @ 20 MPa (mm/s) and n (pressure exponent in the burn rate equation (1) identified above, where the pressure exponent is the slope of the plot of the log of pressure along the x-axis versus the log of the burn rate along the y-axis) were determined/analyzed and are shown in the TABLE 4, below.

TABLE 4

| | EX 6 | CE 1 | EX 7 | CE 2 | CE 3 | EX 8 | EX 9 |
|---|---|---|---|---|---|---|---|
| Tf (K) | 2860 | 2898 | 2824 | 2827 | 2783 | 2724 | 2618 |
| Mole gas/kg | 34.95 | 35.74 | 34.2 | 34.4 | 34.4 | 35.53 | 36.59 |
| Mole gas/100 cc | 6.47 | 6.48 | 6.37 | 6.37 | 6.37 | 6.40 | 6.36 |
| Mass SIFx (mol-K/g) | 99.96 | 103.57 | 96.58 | 97.25 | 95.74 | 96.78 | 95.79 |
| Vol SIFx (mol-K/cc) | 184.92 | 187.78 | 179.93 | 180.20 | 177.40 | 174.21 | 166.58 |
| Density (g/cc) | 1.85 | 1.813 | 1.863 | 1.853 | 1.853 | 1.800 | 1.739 |
| Rb @ 20 MPA (mm/s) | 35.5 | 29.3 | 32.4 | 29.3 | 25.9 | 33.3 | 32.7 |
| N | 0.38 | 0.49 | 0.47 | 0.519 | 0.622 | 0.386 | 0.492 |

Discussion of Results

As shown in Table 4 above, the presence of cupric oxide in conjunction with carbon is necessary to achieve a simultaneous combination of high burning rate and low burning rate pressure exponent. Comparing EX 6 to EX 7 suggests that the amount of cupric oxide present should exceed 2% by weight to achieve maximum burning rate and lowest pressure exponent. Comparison of EX 8 and EX 9, on the other hand, suggest that similarly the amount of carbon present in the formulation should exceed at least 2% to simultaneously realize the maximum burning rate and lowest pressure exponent. In general, increasing the carbon content raises the flame temperature and burning rate of the composition, while increasing cupric oxide raises density and decreases pressure exponent of the composition.

Examples 10-12

Gas generating pyrotechnic compositions in accordance with the invention and as shown in TABLE 5, below, where values are in terms of composition weight percent, were prepared in laboratory mixtures.

TABLE 5

| INGREDIENT | EX 10 | EX 11 | EX 12 |
|---|---|---|---|
| AP | 46.83 | 41.78 | 44.74 |
| GN | 23.17 | 36.72 | 39.76 |
| C | 4.0 | 3.5 | 3.5 |
| CuO | 6.0 | 8.0 | 6.5 |
| NQ | 10.0 | — | — |
| AN | 10.0 | 10.0 | — |
| $NaNO_3$ | — | — | 5.0 |
| $SiO_2$ | — | — | 0.5 |

where,
AP = ammonium perchlorate;
GN = guanidine nitrate;
C = elemental carbon;
NQ = nitroguanidine; and
AN = ammonium nitrate For each of these gas generating pyrotechnic compositions, the theoretical flame temperature ($T_f$), mole gas/kg, mole gas/100 cc, HCl mass %, Mass SIFx (mol-K/g), Vol SIFx (mol-K/cc), density (g/cc), Rb @ 20 MPa (mm/s) and n (pressure exponent in the burn rate equation (1) identified above, where the pressure exponent is the slope of the plot of the log of pressure along the x-axis versus the log of the burn rate along the y-axis) were determined/analyzed and are shown in the TABLE 6, below.

TABLE 6

| | EX 10 | EX 11 | EX 12 |
|---|---|---|---|
| Tf (K) | 2721 | 2582 | 2621 |
| Mole gas/kg | 35.89 | 35.91 | 34.99 |
| Mole gas/100 cc | 6.58 | 6.46 | 6.29 |
| HCI mass % | 11.52 | 9.26 | 8.75 |
| Mass SIFx (mol-K/g) | 97.66 | 92.7 | 91.79 |
| Vol SIFx (mol-K/cc) | 179.1 | 166.7 | 164.8 |
| Density (g/cc) | 1.834 | 1.798 | 1.797 |
| Rb @ 20 MPA (mm/s) | 31.0 | 36.7 | 34.1 |
| N | 0.41 | 0.41 | 0.43 |

Discussion of Results

These examples in which one or more co-fuels or co-oxidizers such as nitroguanidine (NQ), ammonium nitrate and sodium nitrate are utilized, show that performance and ballistic properties of these compositions meet the goals discussed above with the added advantage of a reduction in the amount of hydrogen chloride (HCl) produced during the combustion process.

Thus, there are provided gas generating pyrotechnic compositions that desirably produce, form or generate gas at high temperatures in desirably high yields with rapid burn rates such as to improve or maximize the realizable volumetric performance for gas generating compositions in such applications.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A gas generating pyrotechnic composition, the composition comprising:
- a primary fuel component including guanidine nitrate in a relative amount of 10 to 40 composition weight percent;
- a primary oxidizer component including ammonium perchlorate in a relative amount of 25 to 75 composition weight percent;
- elemental carbon present in a relative amount of 3 to 10 composition weight percent; and
- cupric oxide present in a relative amount of 3 to 15 composition weight percent.

2. The gas generating pyrotechnic composition of claim 1 wherein the elemental carbon is present as graphite.

3. The gas generating pyrotechnic composition of claim 1 wherein upon combustion gas is produced in a relative amount of more than 6 moles of gas per 100 cc of the composition.

4. The gas generating pyrotechnic composition of claim 1 wherein upon combustion gas is produced at a flame temperature in excess of 2400 K.

5. The gas generating pyrotechnic composition of claim 1 additionally comprising a co-fuel comprising nitroguanidine.

6. The gas generating pyrotechnic composition of claim 1 additionally comprising a co-oxidizer comprising ammonium nitrate.

7. The gas generating pyrotechnic composition of claim 1 additionally comprising a co-oxidizer comprising sodium nitrate.

8. The gas generating pyrotechnic composition of claim 1 consisting essentially of:
- a primary fuel component including guanidine nitrate in a relative amount of 15 to 40 composition weight percent;
- a primary oxidizer component including ammonium perchlorate in a relative amount of 25 to 70 composition weight percent;
- elemental carbon present in a relative amount of 3 to 10 composition weight percent; and
- cupric oxide present in a relative amount of 3 to 15 composition weight percent.

9. A method for producing an inflation gas for an occupant restraint system of a motor vehicle, said method comprising:
- igniting a supply of the gas generating pyrotechnic composition of claim 1 to produce a generated gas in high yield and a flame temperature in excess of 2400 K.

10. The method of claim 9 additionally comprising:
- contacting a working fluid with the generated gas to form the inflation gas.

11. The method of claim 9 wherein the ignited gas generating pyrotechnic composition burns at a rate in excess of 30 mm/sec at 20 MPa and with a burning rate pressure exponent of less than 0.5.

12. The method of claim 9 wherein the ignited gas generating pyrotechnic composition burns with a burning rate pressure exponent of no more than 0.4.

13. A gas generating pyrotechnic composition, the composition comprising:
- a primary fuel component "in a relative amount of 10-40 composition weight percent";
- a primary oxidizer component, wherein the primary oxidizer component is ammonium perchlorate;
- elemental carbon present in a relative amount of 3 to 10 composition weight percent; and cupric oxide present in a relative amount of greater than 2 composition weight percent up to 15 composition weight percent, the composition having a flame temperature in excess of 2400 K and upon combustion gas is produced in a relative amount of more than 6 moles of gas per 100 cc of the composition.

14. The gas generating composition of claim 13, upon combustion having a burning rate of 25.4 mm/s at 20.8 MPa.

15. The gas generating composition of claim 13, upon combustion having a burning rate pressure exponent of less than 0.5.

16. A gas generating pyrotechnic composition consisting of:

10 to 40 composition weight percent guanidine nitrate;

25 to 75 composition weight percent ammonium perchlorate;

3 to 10 composition weight percent elemental carbon; and 3 to 15 composition weight percent cupric oxide.

17. The gas generating pyrotechnic composition of claim 16 wherein the elemental carbon is present as graphite.

18. The gas generating pyrotechnic composition of claim 16 wherein upon combustion gas is produced in a relative amount of more than 6 moles of gas per 100 cc of the composition.

19. The gas generating pyrotechnic composition of claim 16 wherein upon combustion gas is produced at a flame temperature in excess of 2400 K.

20. The gas generating composition of claim 13 wherein the primary fuel component is guanidine nitrate.

* * * * *